US005518437A

United States Patent [19]

Nonaka et al.

[11] Patent Number: 5,518,437

[45] Date of Patent: May 21, 1996

[54] TOY TOP AND DRIVE UNIT FOR SPINNING THE TOP

[75] Inventors: Tsuyoshi Nonaka; Minoru Sawada, both of Tokyo, Japan

[73] Assignee: Kabushiki Kaisha Bandai, Tokyo, Japan

[21] Appl. No.: 134,642

[22] Filed: Oct. 12, 1993

[51] Int. Cl.[6] ..... A63H 1/06

[52] U.S. Cl. ..... 446/259; 446/260

[58] Field of Search ..... 446/256, 258, 446/259, 260, 262, 263, 264

[56] References Cited

U.S. PATENT DOCUMENTS

| | | | |
|---|---|---|---|
| 161,581 | 1/1851 | Greene | 446/260 X |
| 809,270 | 1/1906 | Phipps | 446/260 |
| 1,060,612 | 5/1913 | Mangelsdorff | 446/260 |
| 1,368,039 | 2/1921 | Lindstrom | 446/260 |
| 1,499,803 | 7/1924 | Cayo | 446/260 |
| 1,907,419 | 5/1933 | Wetzell | 446/260 X |
| 1,959,635 | 5/1934 | Moore | 446/260 |
| 2,188,824 | 1/1940 | Thigpen | 446/260 |
| 2,245,936 | 6/1941 | Nicholas | 446/260 |
| 2,401,866 | 6/1946 | Greenwood | 446/260 |
| 2,739,415 | 3/1956 | Roberton et al. | 446/263 |
| 2,818,675 | 1/1958 | Glass et al. | 446/260 |
| 3,224,142 | 12/1965 | Pawelka et al. | 446/259 X |
| 4,575,346 | 3/1986 | Ogawa | 446/256 X |
| 4,781,642 | 11/1988 | Stanzel | 446/38 |
| 4,856,790 | 8/1989 | Camillo | 446/256 X |
| 4,867,728 | 9/1989 | Moomaw | 446/259 |
| 4,932,918 | 6/1990 | Onoda | 446/256 X |
| 5,017,172 | 5/1991 | Siefert | 446/263 X |
| 5,024,625 | 6/1991 | MacCarthy | 446/259 |

FOREIGN PATENT DOCUMENTS

| | | | |
|---|---|---|---|
| 6404 | 12/1914 | United Kingdom | 446/256 |
| 301791 | 5/1929 | United Kingdom | 446/256 |
| 374362 | 6/1932 | United Kingdom | 446/260 |

*Primary Examiner*—Robert A. Hafer
*Assistant Examiner*—D. Neal Muir
*Attorney, Agent, or Firm*—R. Gale Rhodes, Jr.

[57] ABSTRACT

A toy top which can also be used as a badge, and a drive unit which can mechanically spin the toy top with ease in a simple manner. The toy top has first engaging portions on the upper surface of the main body thereof, a first hook portion on the outer periphery thereof and a central spindle about which a knob is removably screw-fitted. The toy top comprises a main body having first engaging portions, a first hook portion and a central spindle screw-fitted with a knob while the drive unit comprises a rotatable member having second engaging portions to engage the first engaging portions of the toy top, a spring for rotating the rotatable member, a second hook portion to engage the second hook portion of the toy top and operating member for releasing the engagement of the second hook portion with the first hook portion of the toy top. Further, some modifications of the structures of the toy top and the drive unit are also disclosed. Where the toy top is used as a badge, the knob fitted on the central spindle of the main body of the toy top is first removed and after passing the spindle through the user's clothing, the knob is fitted again on the spindle.

2 Claims, 6 Drawing Sheets

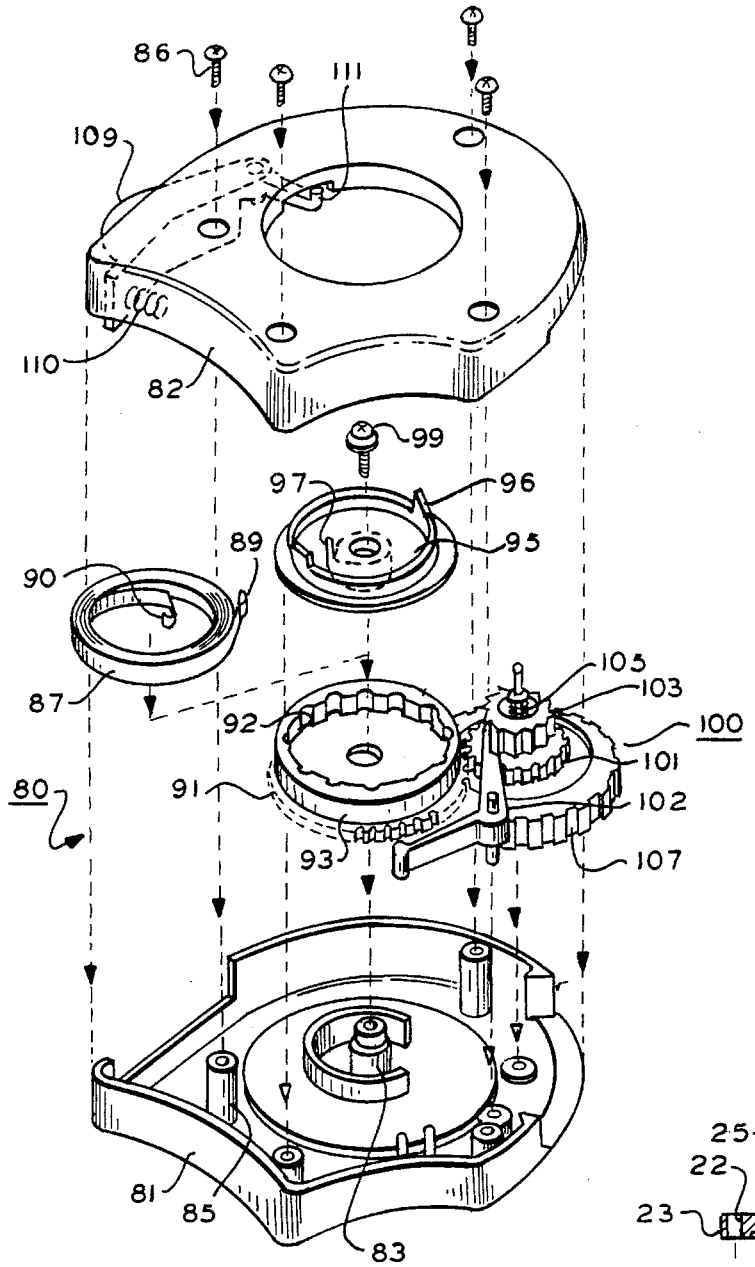
FIG. 10
FIG. 9
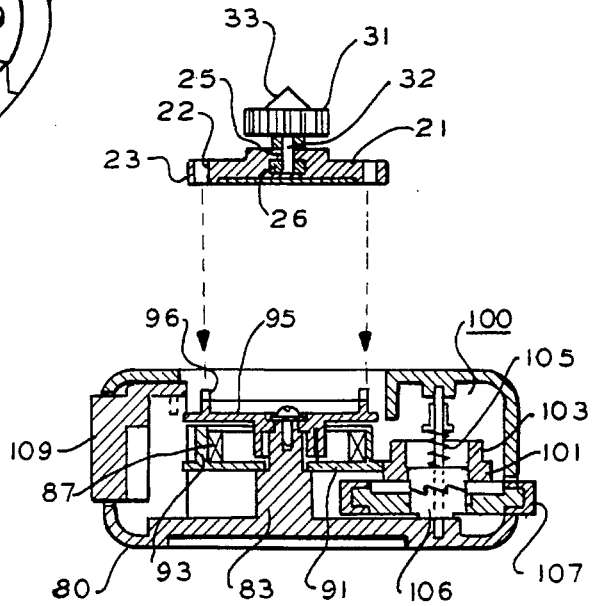

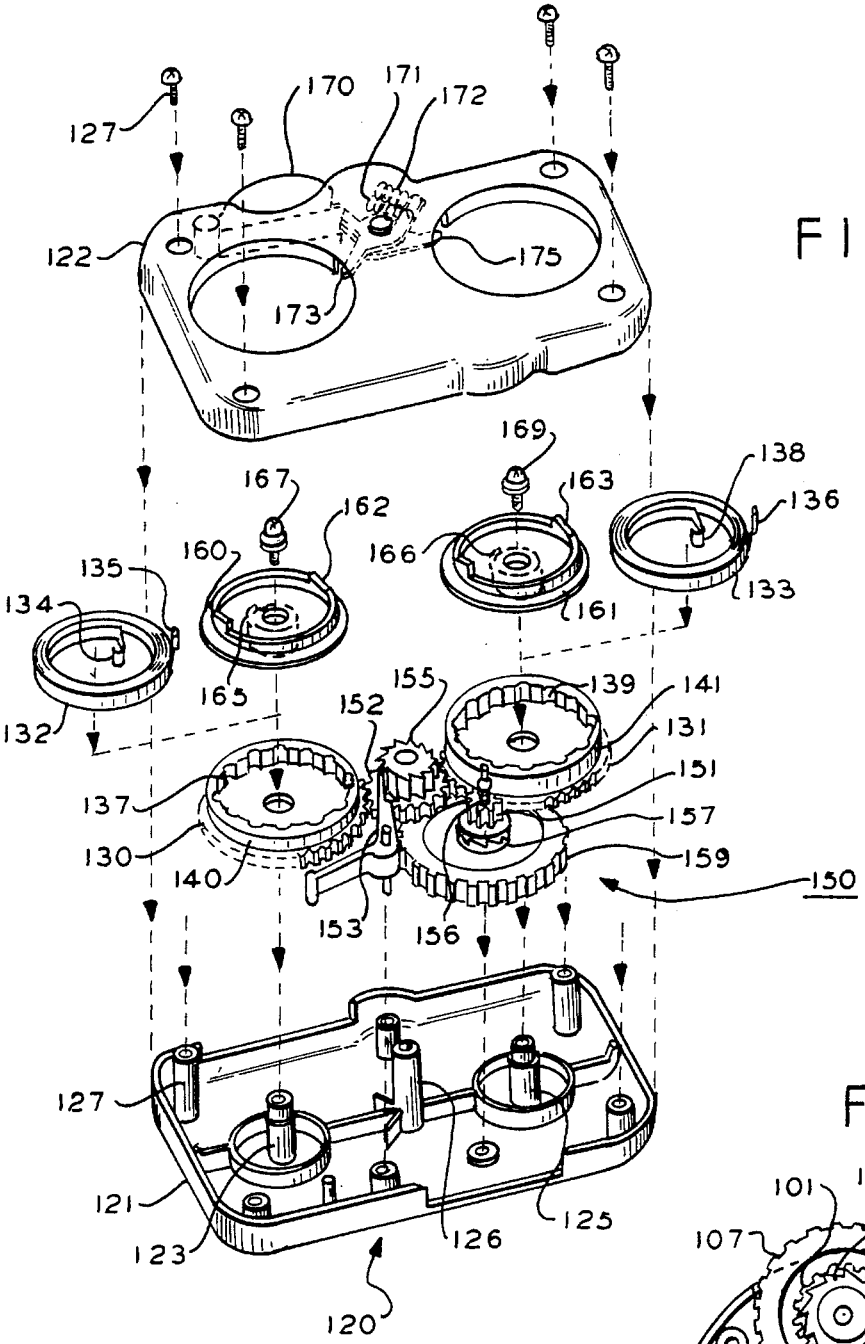
FIG. 12
FIG. 11
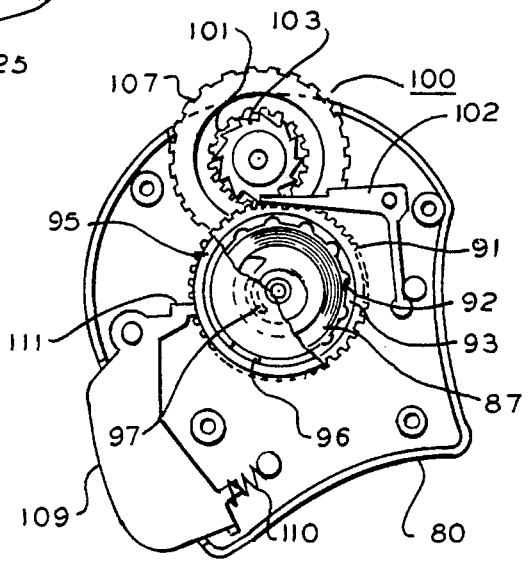

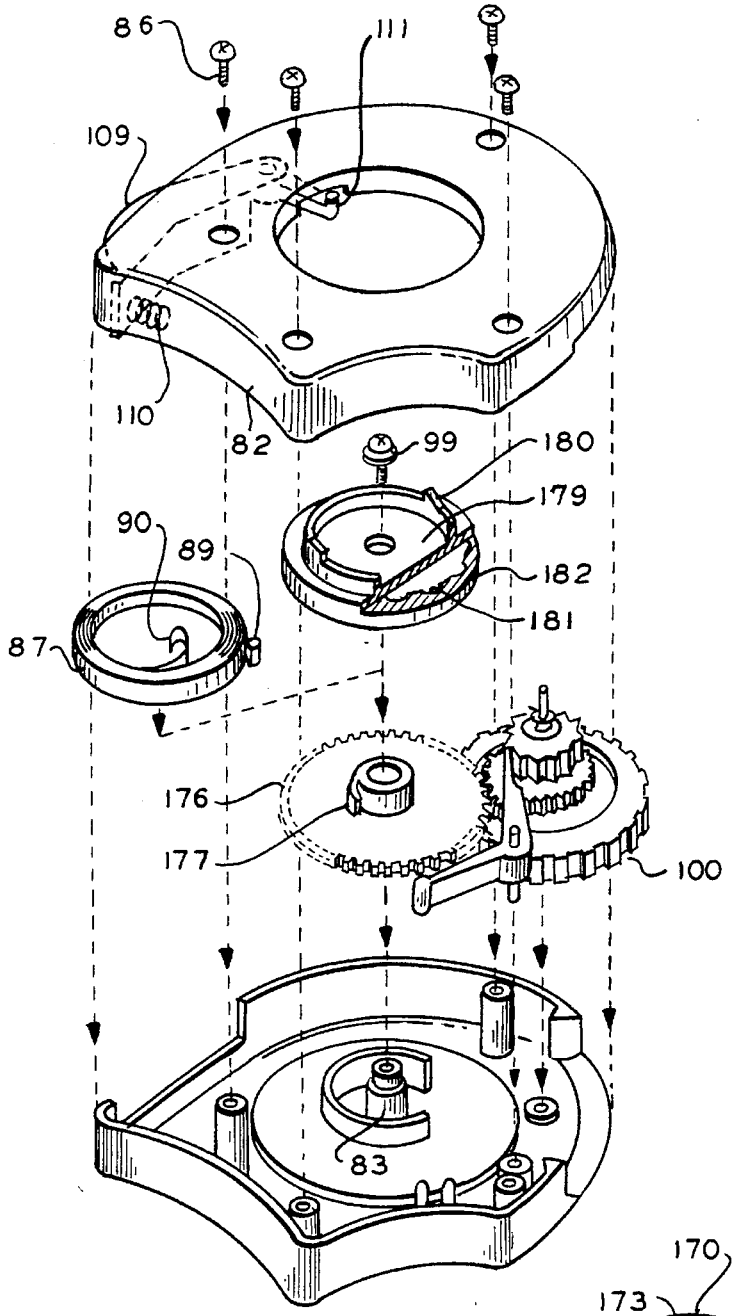
FIG. 14
FIG. 13
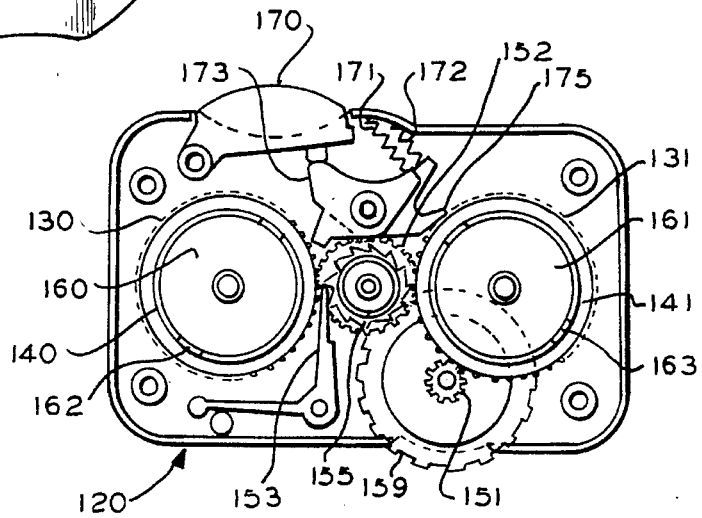

TOY TOP AND DRIVE UNIT FOR SPINNING THE TOP

BACKGROUND OF THE INVENTION

The present invention relates to a toy top also capable of serving as a badge and a drive unit for spinning the top.

The conventional toy top has had a conical body of a certain height so as to allow a string to be wound around the body for spinning the top. This type of toy top has had the disadvantages that it has no other function than merely allowing one to play with it for spinning and not only it is troublesome to wind the string around the conical body of the top for spinning but also it is difficult for one, especially a child, to handle the string so that he can not play with the top until he becomes accustomed to the handling of it. In addition, although there has been such a type of toy top that has a disklike main body attached with a central spindle having a screw-threaded portion about which the knob is fitted, it has also had the problem that it is difficult to attach the central spindle accurately to the main body along the axis of rotation of the main body when the main body is molded.

SUMMARY OF THE INVENTION

The present invention has been made to solve the above-mentioned problems and a first object of the present invention is to provide a toy top capable of serving as a badge in addition to the usual play of top spinning, a second object of the present invention is to provide a toy top which is easy of molding and assembly of the main body and a third object of the present invention is to provide a drive unit capable of mechanically driving the above-mentioned toy top in a simple manner when one wishes to play with the toy top.

In order to achieve the above-mentioned first object of the present invention, the toy top according to the present invention has the following structural features:

(a) the toy top comprises a disklike main body and a central spindle provided at the lower part of the dislike main body;

(b) a first engaging portion coming into engagement with a drive means of the drive unit is provided on the upper surface of the disklike main body and a first hook portion which is hooked by the drive unit is formed on the peripheral surface of the main body; and (c) the central spindle is provided with a screw-threaded portion which is removably fitted with a knob.

Further, in order to achieve the above-mentioned second object of the present invention, the toy top according to the present invention has the following structural features:

(a) the toy top comprises a disklike main body and a knob having a central spindle at the center of the upper surface thereof;

(b) a first engaging portion which comes into engagement with the drive means of the drive unit is provided on the upper surface of the main body;

(c) the main body has, at the center thereof, a central hole extending from the upper surface down to the lower surface thereof;

(d) the main body is attached with a nut at the central portion of the upper surface thereof:

(e) the central spindle is provided with a screw-threaded portion about which the nut is fitted; and (f) the lower part of the knob is conical in shape.

Alternatively, the toy top according to the present invention may have the following structural features for achieving the above-mentioned second object of the present invention:

(a) the toy top comprises a disklike main body and a knob having a central spindle at the center of the upper surface thereof;

(b) a first engaging portion which comes into engagement with the drive means of the drive unit is provided at the upper surface of the main body and a first hook portion held by the drive unit is formed on the peripheral surface of the main body;

(c) a nut is attached to the central portion of the lower surface of the main body;

(d) the central spindle is provided with a screw-threaded portion capable of fitting into the nut; and (e) the lower surface of the knob is conical in shape.

Lastly, in order to achieve the above-mentioned third object of the present invention, the drive unit for driving the toy top according to the present invention has the following structural features:

(a) it comprises a unit body and a drive means disposed within the unit body;

(b) the drive means comprises a rotatable member having a second engaging portion which engages the first engaging portion of the toy top according to the present invention, and a spring for rotating the rotatable member;

(c) the unit body is provided with a second hook portion for removably attaching the main body of the toy top to the drive unit by hooking the first hook portion of the main body of the toy top and an operating member for releasing the hooking of the main body of the toy top by operating the second hook portion.

Alternatively, the drive unit for driving the toy top according to the present invention may have the following structural features:

(a) the drive unit comprises a unit body, a drive means disposed within the unit body and a reverse rotation preventive means arranged at one side of the drive means;

(b) the drive means comprises a rotatable member having a second engaging portion coming into engagement with the first engaging portion of the toy top, a spring for rotating the rotatable member and winding means for winding up the spring; and (c) the unit body is provided with a second hook portion for removably attaching the toy top to the unit body by hooking the first hook portion of the main body of the toy top and an operating member for releasing the hooking of the top by the second hook portion by manipulating the second hooking the hook portion.

Thus the toy top whose main body is formed disklike and whose central spindle at the lower part thereof is removably fitted with the knob can be used as a badge in such a manner that the rotatable spindle is passed through user's clothing from outside after removing the knob and then the knob is again fitted about the spindle from the rear side of the clothing.

Further, the toy top whose main body is formed disklike and whose central hole houses the nut therein so that the screw-threaded portion of the central spindle of the separately formed knob may be removably fitted into the nut, can be used as a badge in such a manner that the central spindle of the knob is passed through the user's clothing from the rear side to the front side and the central spindle projecting through the front side of the clothing is screw-fitted into the nut.

The drive unit for driving the toy top according to the present invention operates such that where it is desired to spin the top, if the main body of the toy top is rotated by the knob with the user's fingers, it is possible to wind up the spring easily by the rotatable member of the drive unit having the second engaging portion to engage the first engaging portion of the main body of the toy top and the elasticity stored state of the spring can be maintained by the second hook portion hooked by the first hook portion at the outer periphery of the main body of the toy top. After that, when the operating member is manipulated while the toy top is held downward, the engagement by the second hook portion with the first hook portion is released so that a torque is applied on the body of the toy top together with the rotatable body of the drive unit due to the elasticity restoring force of the spring.

BRIEF DESCRIPTION OF THE DRAWINGS

FIG. 9 is a perspective view (partially in section) of the essential portions of another embodiment of the drive unit according to the present invention;

FIG. 10 is an exploded view of the essential portions of the drive unit shown in FIG. 9;

FIG. 11 is a plan view (partially cut away) of the essential portions of the drive unit shown in FIG. 9;

FIG. 12 is an exploded perspective view of the essential portions of still another embodiment of the drive unit for the toy top according to the present invention;

FIG. 13 is a plan view of the essential portions (partially cut away) of the drive unit shown in FIG. 12; and FIG. 14 is an exploded perspective view of the essential portions of a further embodiment of the drive unit according to the present invention.

PREFERRED EMBODIMENTS OF THE INVENTION

The preferred embodiments of the present invention will now be described with reference to the accompanying drawings.

Figure 1:
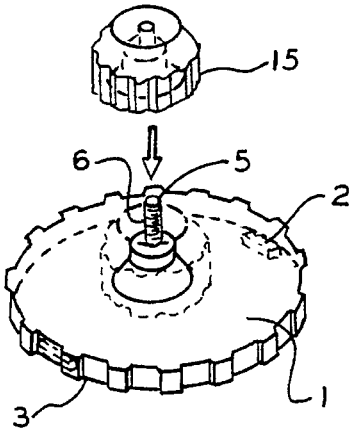
FIG. 1 is an exploded perspective view of the essential portions of one embodiment of a toy top according to the present invention.

In FIG. 1 which shows one embodiment of the present invention, reference numeral 1 designates the main body of a toy top of the present invention which is formed disklike by molding a synthetic resin material. The main body 1 is provided along the outer edge of the upper surface thereof with a plurality of first engaging portions 2 which come into engagement with a drive means of a drive unit 41 for the toy top to be described later. The first engaging portions 2 may be in the form of a projection as shown in FIG. 1, or a groove or through-hole. Further, along the outer peripheral surface of the main body 1 there are provided a toothlike first hook portion 3 which is hooked by the drive unit 41 when the toy top is energized. Further, at the center of the lower surface of the main body 1 there is attached a central spindle 5 having a screw-threaded portion 6 about which a knob 15 is removably fitted.

Figure 2:
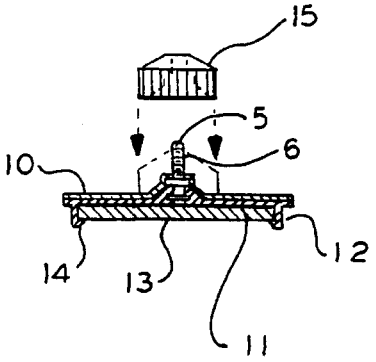
FIG. 2 is a side view (in partial cross section) of the essential portions of another embodiment of a toy top according to the present invention.

FIG. 2 shows another embodiment of the toy top of the present invention. As shown, the main body 10 is formed by molding a synthetic resin material into a disklike casing 12 having a concave portion 11 on the upper surface thereof. The concave portion 11 is attached with a separately formed disklike member 13 such as a medal which is removably fitted into the concave portion 11 by means of retaining claws 14 serving as the first engaging portions 2.

Figure 3:
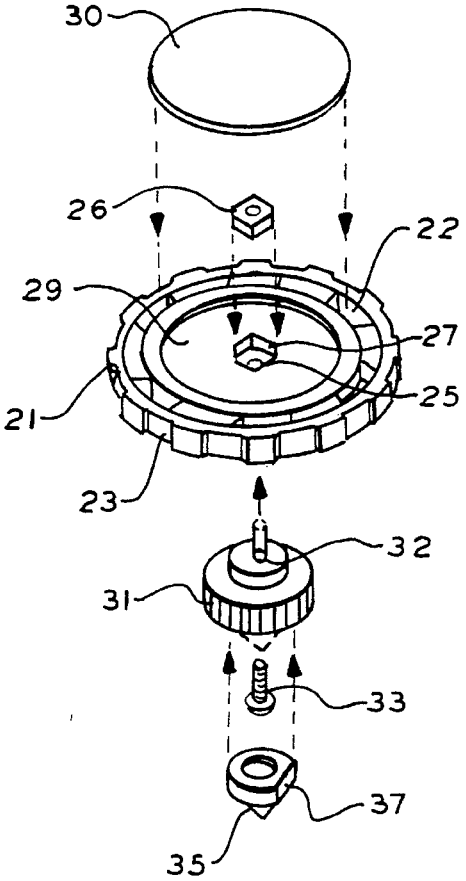
FIG. 3 is an exploded perspective view of still another embodiment of the toy top according to the present invention.
Figure 4:
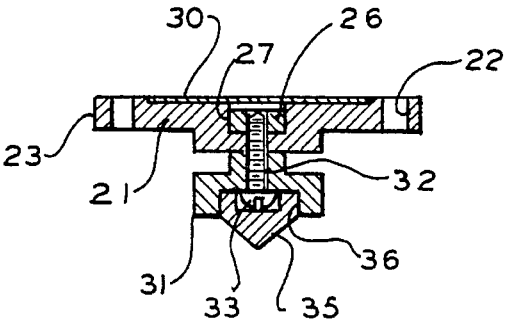
FIG. 4 is a side view (partially in section) of the essential portions of the embodiment shown in FIG. 3.

Still another embodiment of the toy top of the present invention will be described by referring to FIGS. 3 and 4. In these figures, reference numeral 21 designates the main body of the toy top of the present invention which has been die cast molded into a disklike shape. Along the outer edge of the upper surface of the main body 21 there are provided first engaging portions 22 which come into engagement with the drive means of the drive unit 41 to be described later. Each of the first engaging portions 22 may be in the form of a through-hole, or a groove or projection.

Further, on the outer peripheral surface of the main body 21 there are formed a toothlike hook portion 23 which is hooked by the drive unit 41. At the center of the main body 21 there is provided a central hole 25 which extends from the upper surface to the lower surface of the main body 21. On the upper surface of the main body 21 there is formed a hexagonal concave portion 27 for receiving a nut 26 in coaxial relationship with the central hole 25. It is also possible to fix the nut 26 to the lower surface of the main body 21. In that case, the nut 26 is fixed by caulking or bonding.

The main body 21 is provided with a decorative plate 30 attached to the upper surface 29 thereof. The decorative plate 30 can cover the fixing portion for the not 26. Further, it has on the upper surface thereof a pattern such as a comic character which constitutes one of the essential parts of the design of the toy top when the toy top is used as a badge.

Reference numeral 31 designates a knob which is removably attached to the main body 21. The knob 31 is provided with a concave portion 36 at the lower part thereof and a central hole 32 at the center thereof. Within the hole 32 there is attached a boltlike central spindle 33 which makes a fit with the nut 26.

To the lower surface of the knob 31 there is attached a conical cap 35 whose lower end makes the axis of rotation of the knob. The cap 35 is formed by molding a synthetic resin material and the side portion thereof includes a cut-off 37. The cap 35 is fitted into a concave portion 36 of the knob 31 and integrally fixed to the latter by high-frequency welding. Thus the toy top can have an accurate axis of rotation so that when it is spun, it can rotate smoothly to thereby improve the rotational efficiency thereof.

It should be noted in this connection that the central spindle 33 attached to the knob 31 can be made integral with the latter by insert-molding when the knob 31 is molded. In that case, it is a matter of course that the conical cap 35 provided at the lower end of the knob 31 is integrally formed with the latter simultaneously.

Figure 5:
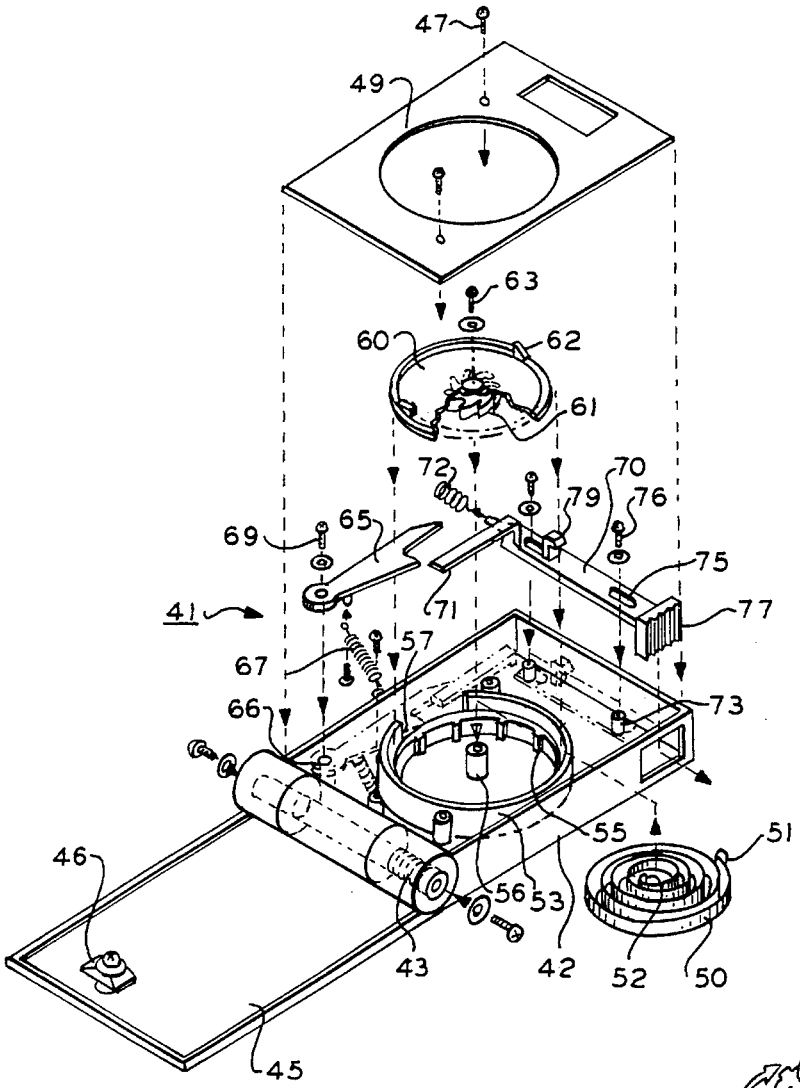
FIG. 5 is an exploded perspective view of one embodiment of a drive unit for the toy top according to the present invention.

One embodiment of the drive unit for the toy top of the present invention will be described with reference to FIG. 5. In the figure, reference numeral 41 designates the drive unit for the toy top which has a flat box-shaped unit body 42 formed by molding a synthetic resin material. At one side of the unit body 42 there is attached a cover member 42 capable of opening and closing and which is urged by a return spring 43 toward a direction in which it opens. The unit body 42 houses therein a retainer 53 which is provided with a plurality of projections 55 for hooking an outer end 51 of a spring 50 and at the center of the retainer there is erected a boss 56.

The boss 56 is attached with a rotatable member 60 by means of a set screw 63. The rotatable member 60 is provided with a plurality of hooking teeth 61 for hooking an inner end 52 of the spring 50 and second sawtooth engaging portions 62 for engaging the first engaging portions 2 (22) of the main body 1 (21) of the toy top. At one side of the retainer 53 there is formed a cutout 57 and a boss 66 is erected near the side portion of the cutout 57. The boss 66 is attached with a spring 67 and a second hook portion 65 facing the first hook portion 3 (23) formed on the outer peripheral surface of the main body 1 (21) of the toy top is swingably attached to the boss 66 by means of a set screw 69.

Inside the second hooking portion 65 there is provided an operating member 70 having an operating piece 71 and a return spring 72 so as to operate the second hooking piece. The operating member 70 has an elongated hole 75 coming into engagement with a boss 73 so that it is movably attached by means of a screw 76. At one end of the operating member 70 there is formed a push-button 77 which projects outside through the side plate of the unit body 42. Further, at one end of the cover member 45 there is erected a stop 46 and at one side of the operating member 70 facing the stop 46 there is erected an engaging claw 79. Further, a cover plate 49 is attached to the upper surface of the unit body 42 by means of screws 47.

Figure 6:
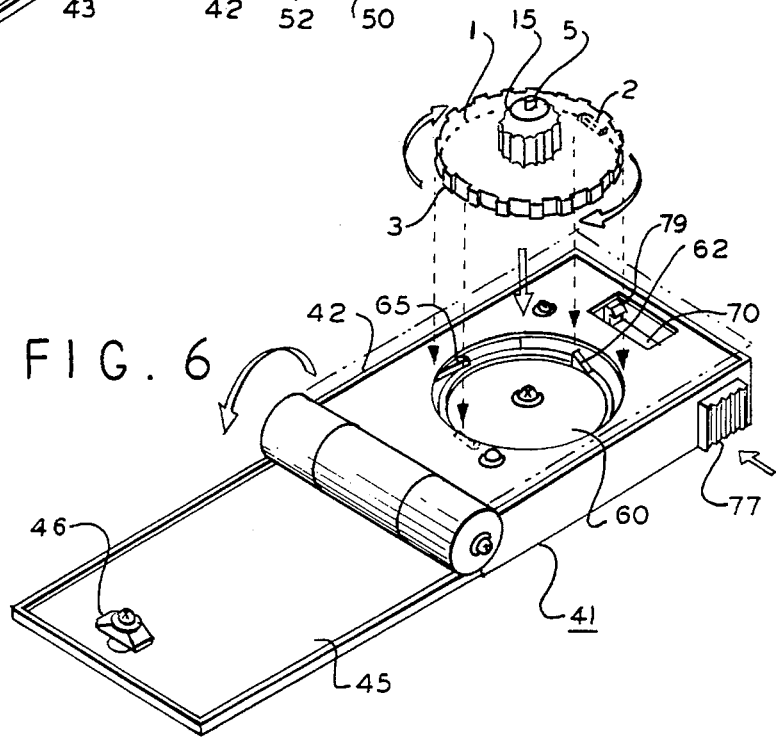
FIG. 6 is a perspective view showing the positional relationship between a further embodiment of the toy top according to the present invention and another embodiment of the drive unit according to the present invention.

Referring to FIG. 6, the main body 1 of the toy top can be used as a badge in such a manner that the central spindle 5 under the body 1 is passed through the user's clothing from the front side to the rear side after removing the knob 15 from the central spindle 5 and then the knob 15 is screw-fitted about the spindle 5 from the rear side of the clothing. Similarly, as shown in FIG. 2, the body 10 of the toy top having the casing 12 can be used as a badge by fitting the disklike member 13 such as a separate medal into the concave portion 11.

Figure 7:
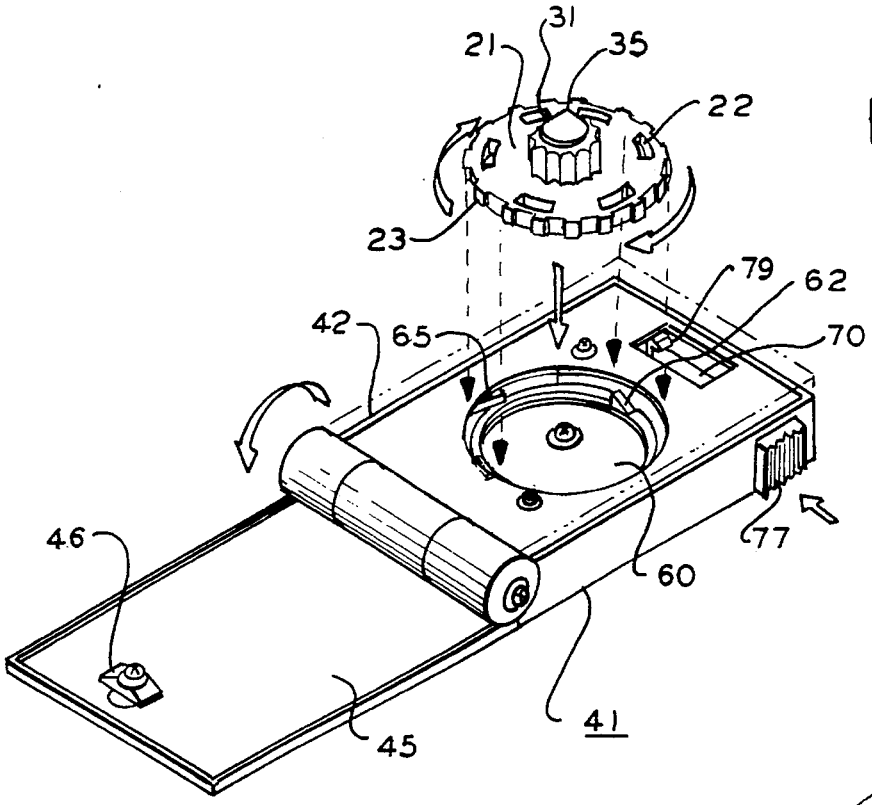
FIG. 7 is a perspective view showing the positional relationship between a still another embodiment of the toy top and the drive unit of the present invention.
Figure 8:
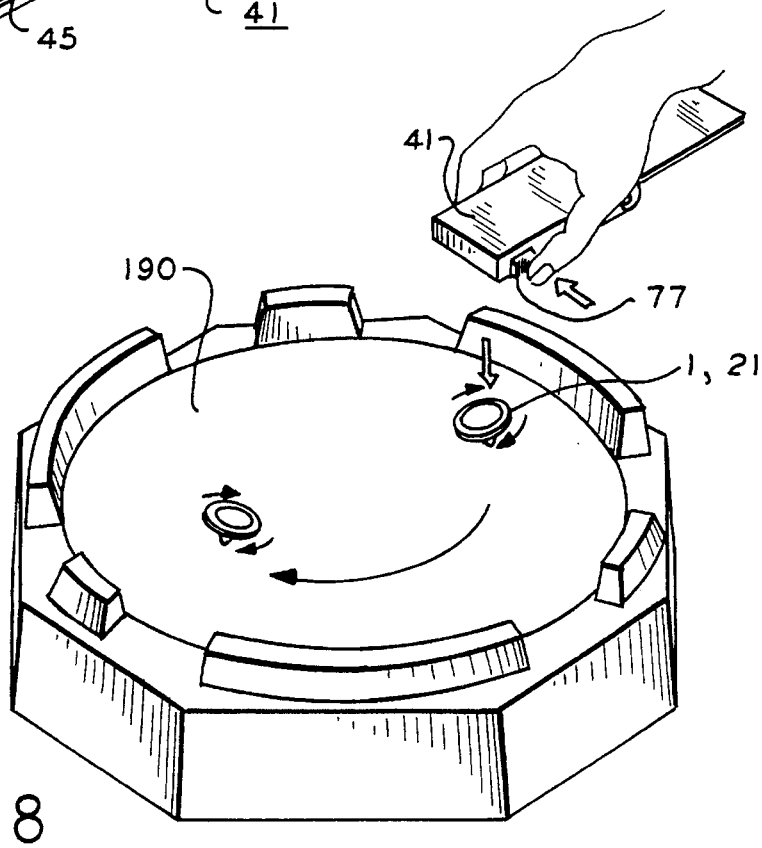
FIG. 8 is a perspective view of the toy top according to the present invention especially showing how to play with the toy top.

Further, where the toy top is spun, when the push-button 77 of the drive unit 41 is pressed down to open the cover member 45 as shown in FIG. 7 and the knob 31 is rotated after placing the main body 21 of the toy top on the rotatable member 60, the first engaging portions 22 come into engagement with the second engaging portions 62 allowing the spring 50 to be wound up together with the rotary member 60. In this case, the first hook portion 23 formed on the peripheral surface of the main body 21 is hooked by the second hook portion 65 so that the energy stored state of the spring 50 is maintained. In the above state, if the drive unit 41 is held upside down and the push-button of the operating member 70 is pressed down at a position above a playing table 190, the first hooking portion 23 is released from its engagement with the second hooking portion 65 and a torque is applied on the rotatable member 60 by the elasticity restoring force of the spring 50 so that it is possible to allow the toy top to fall down on the playing table while it is rotating.

Next, another embodiment of the drive unit of the present invention will be described with reference to FIGS. 9 through 11. In these figures, reference numeral 80 designates a drive unit for the toy top of the present invention, which comprises a flat box-shaped body made up of an upper half 82 and a lower half 81 formed by molding a synthetic resin material. At substantially the center of the lower half 81 there is erected a bearing shaft 83 on which a spur gear 91 is rotatably supported. The spur gear 91 is formed integral with a tubular portion 93 which is provided with a plurality of corrugations 92 on the inner surface thereof for hooking an outer end 89 of a spring 87.

At the upper part of the tubular portion 93 there is provided a rotatable member 95 which is integrally formed with second sawtooth engaging portions 96 respectively coming into engagement with the first engaging portions 22 of the main body 21 of the toy top and a hook 97 for hooking an inner end 90 of the spring 87. The rotatable member 95 is rotatably fixed about the support shaft 83 by means a set screw 99 to be fitted into the top end of the support shaft 83.

As a winding means 100 for the above-mentioned spring 87, a gear 101 is provided near the spur gear 91 so as to mesh with the latter. At one end of the rotatable shaft of the gear 101 a thrust spring 105 is attached and at the other end thereof a winding wheel 107 provided with a clutch gear 106 engageable only when it rotates clockwise is rotatably supported. Further, as a reverse rotation preventive means for hindering the rewinding of the spring 87, a stop gear 103 constituting a latchet mechanism is integrally formed with the gear 101 and a stop claw 102 to engage the stop gear 103 is provided near the latter.

The upper half 82 of the drive unit 80 is provided with an operating member 109 which has a second hook portion 111 and which is located at a position opposing the first hook portion 23 of the main body of the toy top 21 to be placed on the rotatable member 95 is so supported as to be operated from outside. The upper and lower halves 82 and 81 of the drive unit are assembled integrally with a plurality of bosses 85 by means of set screws 86.

Further, where the toy top is spun, the toy top is placed on the rotatable member 95 of the drive unit 80 with the knob 31 on the main body 21 held upward. In this case, the first engaging portion 22 of the main body 21 is hooked by the second engaging portion 96 of the rotatable member 95 and at the same time, the first hooking portion of the main body 21 is hooked by the second hook portion 111 of the operating member 109. In this state, the main body 21 of the toy top is maintained so as not to rotate with the rotatable member 95 of the drive unit 80.

When the winding wheel 107 of the winding means 100 of the drive unit is rotated forward and rearward in the above state, only the clockwise rotation of the wheel 107 is transmitted to the gear 101. Then the clockwise rotation of the gear 101 is transmitted to the spur gear 91 and the tubular portion 93 integral with the spur gear 91 is rotated counter-clockwise so that the spring 87 is wound up while the outer end 89 of the spring is hooked by the corrugations 92 on thinner surface of the tubular portion 93. Thus it is possible lto wind up the spring 87 simply by a small force for merely rotating the winding ring 107 forward and rearward.

Next, when the drive unit 80 is reversed to cause the toy top to face downward and the operating member 109 is manipulated, the operating member 109 is released from the first hook means 111 with the result that the elasticity restoring force of the spring 87 is effected to apply a torque on the main body 21 of the toy top together with the rotatable member 95 through the hook 97 engaging the inner end 90 of the spring 87. After that, the toy top is allowed to fall down on the playing table or the like by separating from the drive unit 80 while it is rotating.

FIGS. 12 and 13 show still another embodiment of the drive unit of the present invention in which two toy tops can be driven simultaneously. This drive unit 120 is in the form of a flat box-shaped body made up of an upper half 122 and a lower half 121 formed by molding a synthetic resin material. The upper half 122 is provided with three support shafts 123, 125 and 126 which are erected in spaced apart relationships with one another.

Rotatably supported by the support shafts 123 and 125 are spur gears 130 and 131 which are formed integral with tubular portions 140 and 141 which are provided with pluralities of projections 137 and 139 on the inner surfaces thereof, respectively, so as to hook the outer ends 135 and 136 of springs 132 and 133. Similarly, a gear 152 meshing with the spur gears 130 and 131 is supported by the support shaft 126. The gear 152 has a stop gear 155 formed integral therewith so as to constitute a latchet mechanism as a reverse rotation preventive means for hindering the rewinding of the springs 132 and 133 and there is provided a engaging claw 153 in the vicinity of the gear 155 so as to mesh with the latter.

Over the tubular portions 140 and 141 there are provided rotatable members 160 and 161, respectively. Further, the rotatable members 160 and 161 have second sawtooth engaging portions 162 and 163 and hooks 165 and 166 for hooking the inner ends of the springs 132 and 133 formed integral therewith, respectively. These rotatable members 160 and 161 are rotatably fitted about the support shafts 123 and 125, respectively, by means of set screws 167 and 169 fitted into the top ends of the support shafts.

As a winding means 150 for the springs 132 and 133, there is provided a pinion 151 which meshes with the spur gear 131. One end of the rotatable shaft of the pinion 151 is attached with a thrust spring 156 and the other end thereof rotatably supports a winding ring 159 provided with a clutch gear 157 which is engageable only when it rotates clockwise.

The lower half 122 of the drive unit is provided with return springs 171 and 172 and second hook portions 173 and 175 supported at positions opposing to the first hook portions 23 of the main bodies 21 of the two toy tops to be placed on the rotatable members 160 and 161, respectively. Further, operating member 170 capable of being controlled from outside the drive unit is supported near the second hook portions 173 and 175. The two halves 121 and 122 of the drive unit are integrally assembled with respect to bosses 127 by means of set screws 129.

Where the toy tops are spun, the main bodies 21 of the two toy tops are placed on the rotatable members 160 and 161, respectively, with the knob 31 on the body 21 of each of the toy tops facing upward and the first engaging portions 22 of the main bodies 21 are caused to be hooked by the second engaging portions 162 and 163, respectively, and at the same time, the first hook portions 23 on the outer peripheral surfaces of the main bodies 21 are caused to be hooked by the second hook portions 173 and 175. Consequently, in the above state, the main bodies 21 of the toy tops are kept unrotated with the rotatable members 160 and 161, respectively.

When, in the above state, the winding wheel 159 of the winding means 150 of the drive unit 120 is rotated forward and rearward, the pinion 150 rotates by the clutch gear 157 only in the clockwise direction and the rotation of this pinion 150 in turn transmitted to the spur gears 131, the gear 152 and the spur gear 130. In this case, the tubular portions 140 and 141 are rotated counter-clockwise together these spur gears 130 and 131 and at the same time, the springs 132 and 133 are wound up with the outer ends 135 and 136 being hooked by the inner projections 137 and 139, respectively. Thus it is possible to energize the elastic members 132 and 133 in a simple manner by using a small force required only for rotating the winding wheel 159 forward and rearward.

Next, when the drive unit 120 is turned upside down to cause the toy tops to face downward and the operating member 170 is manipulated, the hookings of the second hook portions 173 and 175 with respect to the first hook portions 23 of the main bodies 21 of the toy tops are released which results in that due to the elasticity restoring forces of the springs 132 and 133, a torque is applied to each of the main bodies 21 of the toy tops through the hooks 165 and 166 engaging the inner ends 134 and 138 of the springs 132 and 133, respectively. After that, the two toy tops can be made to leave away from the drive unit 120 and to fall down on the playing table as they rotates at a high speed.

In the above embodiment of FIG. 10, the inner end 90 of the spring 87 is connected to the hook 97 of the rotatable member 95 and the outer end 89 thereof is connected to the tubular portion 93 but such position of the spring 87 can be reversed as shown in FIG. 14.

That is, FIG. 14 shows a still further embodiment of present invention wherein a spur gear 176 is rotatably supported by the support shaft 83. Further, on the spur gear 177 there is provided a hooklike projection 177 for hooking the inner end 90 of the spring 87 and above the spur gear 176 there is provided a rotatable member 179 which is formed integral with a tubular portion 182 which is provided with second sawtooth engaging portions 180 to engage the first engaging portions 22 of the main body 21 of the toy top and a plurality of corrugations 181 on the inner surface thereof. The rotatable member 179 is rotatably mounted on the support shaft 83 by means of a screw 99 to be fixed to the top end of the shaft 83. The winding means 100 for the spring 87 and the operating member 109 are constructed in the same manner as in the case of FIG. 10 embodiment.

As described above, the present invention has various advantages, namely:

the toy top according to the present invention which has the knob removably fitted about the central spindle extending from the lower part of the main body thereof has the effect of being able to be used as a badge in such a manner that the knob is removed from the central spindle, the central spindle is passed through the user's clothing from the front side to the rear side and the knob is screw-fitted about the central spindle.

The toy top according to the present invention in which the knob having the central spindle removably attached to the rear side of the main body thereof has also the effect of being able to be used as a badge in such a manner that the knob is removed from the main body of the toy top and after the central spindle is passed through the user's clothing from the rear side to the front side, the tip of the externally rejecting central spindle is screw-fitted into the nut located within the main body of the toy top. Further, since it is sufficient for the main body of the toy top to have a central hole without the necessity of providing any support shaft on the main body, the main body can be easily formed by molding a synthetic resin material. Moreover, as no troublesome insert molding is required, the machinability can be improved and the manufacturing cost can be reduced. Still further, since the central spindle of the knob has the ordinary screw-threaded portion engageable with the nut within the main body of the toy top, the machinability can be improved and the manufacturing cost can be reduced as in the case of the main body. Lastly, the knob can be assembled simply into the main body by merely screw-fitting the central spindle into the nut within the main body.

Likewise, the drive unit for the toy top according to the present invention has the effect of being able to be formed flat so that it is convenient for one to carry it by putting it into the user's pocket or the like.

Further, the drive unit for the toy top according to the present invention has the advantage that where the toy top is spun, the main body of the toy top can be attached to the drive unit by causing the first engaging portion on the upper surface of the main body to engage the second engaging portion of the drive unit and causing the first hook portion on the outer peripheral surface of the main body to be hooked by the second hook portion of the drive unit, and it is possible to wind up the spring simply by merely rotating the main body of the toy top. When the first hook portion is released from the second hook portion, the main body of the toy top can be applied with a torque due to the elasticity restoring force of the spring so that the toy top can be energized simply without using a string as has been the case with the conventional toy spinning and even a little child can enjoy toy top spinning with ease.

Furthermore, the toy top drive unit according to the present invention having the winding means makes it possible to indirectly wind up the spring in such a manner that the main body of the toy top is attached to the drive unit in the same manner as the above and when spinning the toy top, only the winding means is rotated. Consequently, it is not unnecessary to directly wind up the spring by rotating the main body of the toy top and the spring can be wound up simply with a small force sufficient for moving the winding means.

What is claimed is:

1. A drive unit for imparting rotation to a toy top, comprising:

a base provided with an outwardly extending generally circular wall including an inner surface provided with a cut out and a plurality of first spaced apart inwardly extending projections;

a generally cylindrical boss extending outwardly from said base generally centrally of said circular wall;

a coiled spring mounted on said base around said boss and inside of said circular wall, said spring including a hooked inner end and a hooked outer end, said hooked outer end for engaging one of said first projections to secure said outer end during winding of said spring;

a generally circular, flat rotatable member provided with upper and lower surfaces, said rotatable member provided with a centrally formed hole, said rotatable member for being received within said circular wall with said boss extending upwardly through said central hole, said upper surface of said rotatable member provided with a plurality of outwardly extending projections for engaging the top and for permitting the top to impart rotation to said rotatable member in a first direction of rotation;

said bottom surface of said rotatable member provided with a plurality of outwardly extending and generally centrally disposed hooking teeth for engaging said inner end of said spring to wind said spring upon rotation being imparted to said rotatable member by said top in said first direction of rotation;

a pivotally mounted stop member spring biased toward said circular wall, said stop member provided with an outwardly extending stop projection for extending through said cutout in said wall to engage the top and to prevent the impartation of rotation to the top while said spring is being wound; and a slidably mounted operating member for engaging said stop member, said operating member spring biased to prevent said operating member from moving said stop projection out of engagement with the top, said operating member for being operated manually to move said stop projection out of engagement with the top to permit said spring to unwind and impart rotation to said top through said projections provided on said top surface of said rotatable member, said rotation imparted to said top being in a second direction of rotation opposite to said first direction of rotation.

2. Combination toy apparatus, comprising:

a toy top and a drive unit for imparting rotation to said top;

said top including a disklike main body having top and bottom surfaces and an outer peripheral surface substantially perpendicular to said top and bottom surfaces, said peripheral surface provided with a tooth-like hook portion and said main body provided with a plurality of through holes extending therethrough from said top surface to said bottom surface, said top including a knob extending centrally outwardly from said bottom surface and said knob provided with a plurality of outwardly extending rib-like members extending perpendicular to said main body, and said top including a generally conical member on which said top rotates and which conical member extends outwardly from said knob;

said drive unit including rotational energy storage means including a coil spring and a rotatably mounted member having a saw-tooth engaging portion for extending into said through holes, said rotatable member having a surface opposite said toy top engagement surface provided with hooking teeth for engaging said coiled spring to wind said coiled spring to provide stored rotational energy upon said top being manually rotated in a first direction of rotation by said rib-like members provided on said knob;

said drive unit further including a pivotally mounted latching member spring biased in a first direction of pivotal movement and which latching member includes a latching shoulder for engaging said tooth-like hooked portion provided on said outer peripheral surface of said main body of said top to prevent said drive unit from imparting rotation to said top while said spring is being wound; and said drive unit further including an operating member mounted for reciprocal linear movement in opposed first and second directions, said operating member spring biased for linear movement in said first direction and said operating member provided with a release arm for engaging said latching member upon said operating member being moved linearly in said second direction and said operating member for pivoting said latching member in a second direction of pivotal movement opposite to said first direction of pivotal movement to disengage said latching shoulder from said tooth-like portion provided on said periphery of said main body to permit said spring to unwind and impart rotational movement to said rotatable member in a second direction of rotation opposite to said first direction of rotation and to cause said operating member to impart rotation to said top in said second direction of rotation through said saw-tooth engaging portion residing in said through holes.

* * * * *